US007201476B2

(12) United States Patent
Buchanan et al.

(10) Patent No.: US 7,201,476 B2
(45) Date of Patent: Apr. 10, 2007

(54) INKJET PRINTHEAD WITH BUBBLE HANDLING PROPERTIES

(75) Inventors: Jeffery James Buchanan, Lexington, KY (US); Bruce David Gibson, Lexington, KY (US); Steven Robert Komplin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 304 days.

(21) Appl. No.: 11/008,834

(22) Filed: Dec. 10, 2004

(65) Prior Publication Data

US 2006/0125892 A1 Jun. 15, 2006

(51) Int. Cl.
*B41J 2/175* (2006.01)
*B41J 2/05* (2006.01)

(52) U.S. Cl. ..... 347/87; 347/65; 347/86

(58) Field of Classification Search ..... 347/85, 347/87, 86, 40, 43, 65, 66, 71
See application file for complete search history.

(56) References Cited

U.S. PATENT DOCUMENTS

| | | | | |
|---|---|---|---|---|
| 4,752,787 | A | 6/1988 | Matsumoto et al. | |
| 5,131,539 | A | 7/1992 | Karita et al. | |
| 5,244,092 | A | 9/1993 | Karita et al. | |
| 5,262,802 | A | 11/1993 | Karita et al. | |
| 5,371,528 | A | 12/1994 | Izumida et al. | |
| 5,497,178 | A | 3/1996 | DeFosse et al. | |
| 5,563,643 | A | 10/1996 | Carlotta et al. | |
| 5,576,750 | A | 11/1996 | Brandon et al. | |
| 5,650,810 | A | 7/1997 | Muto | |
| 5,659,345 | A | 8/1997 | Altendorf | |
| 5,696,546 | A | 12/1997 | Narang et al. | |
| 5,708,466 | A | 1/1998 | Noguchi | |
| 5,812,165 | A | 9/1998 | Boyd et al. | |
| 5,894,461 | A * | 4/1999 | Fosler et al. | 369/30.31 |
| 5,900,894 | A | 5/1999 | Koizumi et al. | |
| 5,926,195 | A | 7/1999 | Domhoff et al. | |
| 5,940,104 | A | 8/1999 | Karita et al. | |
| 6,003,977 | A | 12/1999 | Weber et al. | |
| 6,003,983 | A | 12/1999 | Lowry et al. | |
| 6,007,191 | A | 12/1999 | Fujii et al. | |
| 6,033,063 | A | 3/2000 | Tomikawa et al. | |
| 6,039,437 | A | 3/2000 | Tsujimoto | |
| 6,042,225 | A | 3/2000 | Altendorf et al. | |
| 6,113,223 | A | 9/2000 | Tanaka et al. | |
| 6,139,133 | A | 10/2000 | Ishikawa | |
| 6,139,137 | A | 10/2000 | Stathem et al. | |
| 6,206,501 | B1 | 3/2001 | Ishii et al. | |
| 6,260,961 | B1 | 7/2001 | Seu et al. | |
| 6,290,348 | B1 | 9/2001 | Becker et al. | |
| 6,293,664 | B1 | 9/2001 | DeFosse et al. | |
| 6,331,054 | B1 | 12/2001 | Seu et al. | |
| 6,331,055 | B1 | 12/2001 | Miller et al. | |

(Continued)

*Primary Examiner*—Lamson Nguyen
*Assistant Examiner*—Lisa M. Solomon
(74) *Attorney, Agent, or Firm*—Michael Best & Friedrich

(57) ABSTRACT

Some embodiments of the invention provide a printhead having a chip feed extending between an ink reservoir and printhead nozzles, wherein the chip feed has an inlet, and outlet, and one or more projections or recesses in a transition surface of the chip feed. The transition surface and the projection or recess can be inclined with respect to the outlet of the chip feed, and in some cases can be curved to present a concave or convex shape toward the outlet of the chip feed.

22 Claims, 3 Drawing Sheets

U.S. PATENT DOCUMENTS 6,382,778 B1 5/2002 Iijima et al.
6,402,310 B1 6/2002 Maeda et al.
6,406,135 B1 6/2002 Watanabe et al.
6,416,155 B1 7/2002 Takahashi et al.
6,457,821 B1 10/2002 Liu et al.
6,481,832 B2 11/2002 Liu et al.
6,513,920 B1 2/2003 Deshmukh et al.
6,520,633 B2 2/2003 Nakamura
6,527,382 B2 3/2003 Hou et al.
6,561,637 B2 5/2003 Hino
6,578,956 B1 6/2003 Hosaka
6,634,742 B2 10/2003 Owaki et al.
6,679,595 B2 1/2004 Yamada et al.
6,685,310 B2 2/2004 Kaga et al.
6,742,882 B2 6/2004 Nakamura
6,761,442 B2 7/2004 Hou et al.
6,840,609 B2 * 1/2005 Lo et al. ..... 347/86
6,851,800 B1 * 2/2005 Seu ..... 347/86
2001/0012041 A1 8/2001 Boyd et al.
2001/0030676 A1 10/2001 Owaki et al.
2002/0075367 A1 * 6/2002 Chiu ..... 347/86
2002/0105567 A1 8/2002 Yamada et al.
2002/0140789 A1 10/2002 Tajima et al.
2002/0163567 A1 11/2002 Hou et al.
2003/0030709 A1 2/2003 Deshmukh et al.
2003/0085971 A1 5/2003 Hou et al.
2003/0107623 A1 6/2003 Sato et al.
2004/0012661 A1 1/2004 Lin et al.

* cited by examiner

INKJET PRINTHEAD WITH BUBBLE HANDLING PROPERTIES

BACKGROUND OF THE INVENTION

Conventional inkjet printers typically include one or more printheads in which ink is stored. Such printheads have one or more ink reservoirs in fluid communication with nozzles through which ink exits the printhead toward a print medium. In many cases, the nozzles are located in one or more nozzle plates coupled to a body of the printhead. Each nozzle plate can be or include a chip having heat transducers that heat and vaporize the ink, thereby ejecting the ink from the nozzles.

In some conventional inkjet printheads, air bubbles in the ink can block at least a portion of ink flow through the printhead, and in some cases can cause sufficient flow restriction to deprime at least some of the printhead nozzles. In some conventional inkjet printheads, ink flows along a fluid path extending from an ink reservoir and through a filter tower, an ink via, and a short feed tube feeding ink to the nozzles. In such printheads, the short feed tube is typically completely open to the ink via and has no features inhibiting bubble blockage of the fluid path. In other conventional inkjet printheads, the fluid path extends from an ink reservoir and through a filter tower, an ink via, and a narrow feed tube that is not completely open to the ink via. Bubbles can accumulate in the narrow feed tubes to cause depriming.

SUMMARY OF THE INVENTION

Some embodiments of the present invention provide an inkjet printhead comprising a housing having an ink reservoir; an outer surface of the housing; an ink feed at least partially defining a fluid path extending from the ink reservoir toward the outer surface; a chip feed having an inlet in fluid communication with the ink feed and an outlet in fluid communication with the outer surface; a first plane at the inlet defining a first cross sectional area of the chip feed at the inlet, the first plane separating the ink feed from the chip feed; a second plane in which the outlet lies, the second plane defining a second cross sectional area of the chip feed at the outlet, the second cross sectional area being substantially greater than the first cross-sectional area; and at least one of a projection and a recess positioned along a transition surface of the chip feed between the inlet and the outlet.

In some embodiments of the present invention, an inkjet printhead is provided, and comprises a housing having an ink reservoir; an outer surface of the housing; an ink feed at least partially defining a fluid path extending from the ink reservoir toward the outer surface; a chip feed positioned to fluidly couple the ink feed and the outer surface, the chip feed defining a chamber having a roof elongated in a first direction and an outlet elongated substantially in the first direction; and at least one of a projection and a recess extending along at least part of the roof in the first direction.

Some embodiments of the present invention provide an inkjet printhead comprising: a housing having an ink reservoir; an outer surface of the housing; an ink feed at least partially defining a fluid path extending from the ink reservoir toward the outer surface; an chip feed having an inlet in fluid communication with the ink feed and an outlet in fluid communication with the outer surface; a first plane at the inlet, the first plane defining a first cross sectional area of the chip feed at the inlet, the first cross-sectional area defined at least in part by a first width and a first length greater than the first width; a second plane in which the outlet lies, the second plane defining a second cross-sectional area of the chip feed at the outlet, the second cross-sectional area defined at least in part by a second width and a second length greater than the second width, the second length being substantially greater than the first length; and at least one of a projection and a recess extending along a transition surface of the chip feed between the inlet and the outlet.

Other features and aspects of the invention will become apparent to those skilled in the art upon review of the following detailed description, claims and drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings. In addition, terms such as "first", "second," and "third" are used herein and in the appended claims for purposes of description and are not intended to indicate or imply relative importance or significance.

Further aspects of the present invention, together with the organization and manner of operation thereof, will become apparent from the following detailed description of the invention when taken in conjunction with the accompanying drawings, wherein like elements have like numerals throughout the drawings.

DETAILED DESCRIPTION

Figure 1:
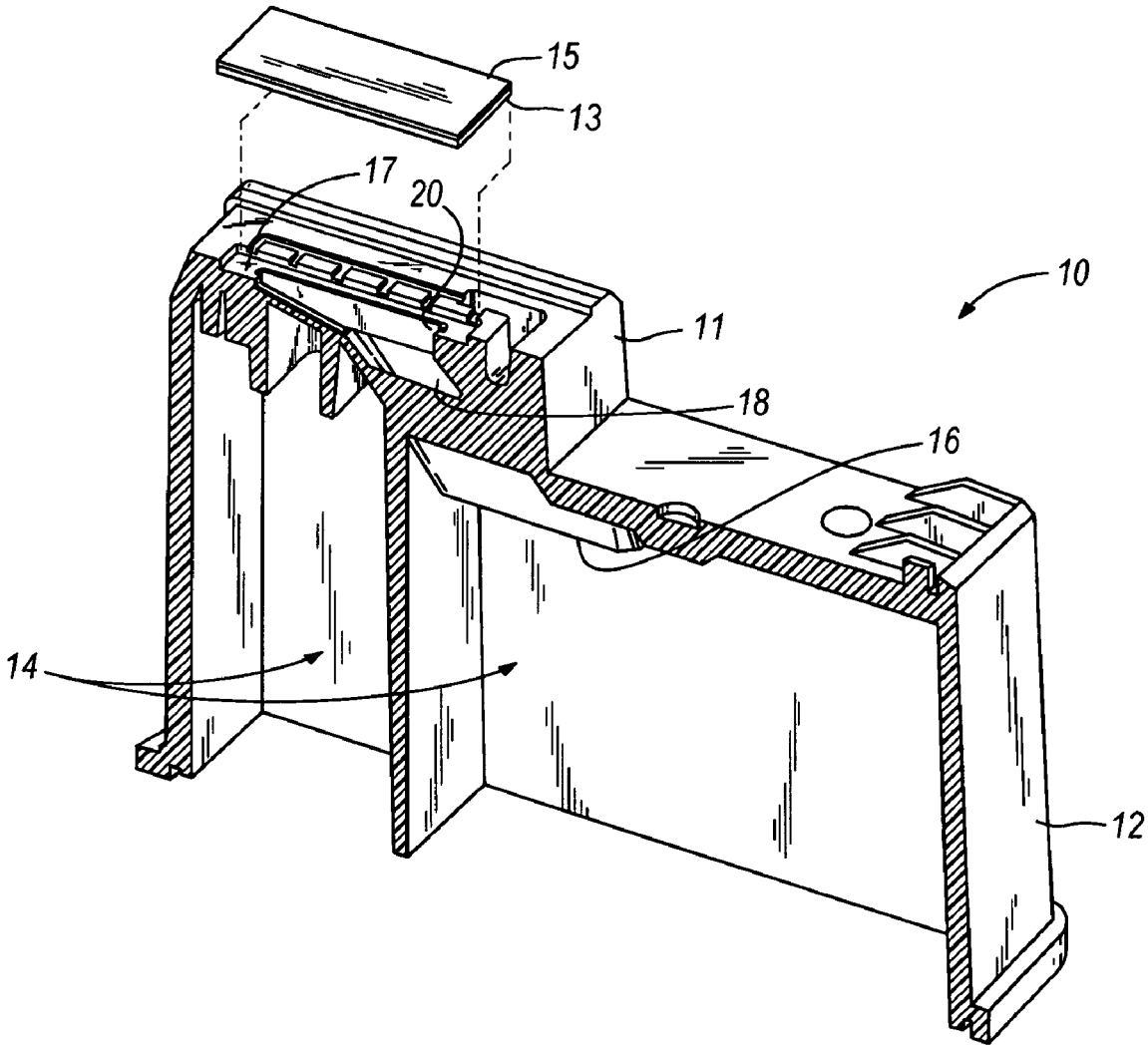
FIG. 1 is cross-sectional perspective view of an embodiment of an inkjet printhead shown upside down with respect to a typical operating position.
Figure 2:
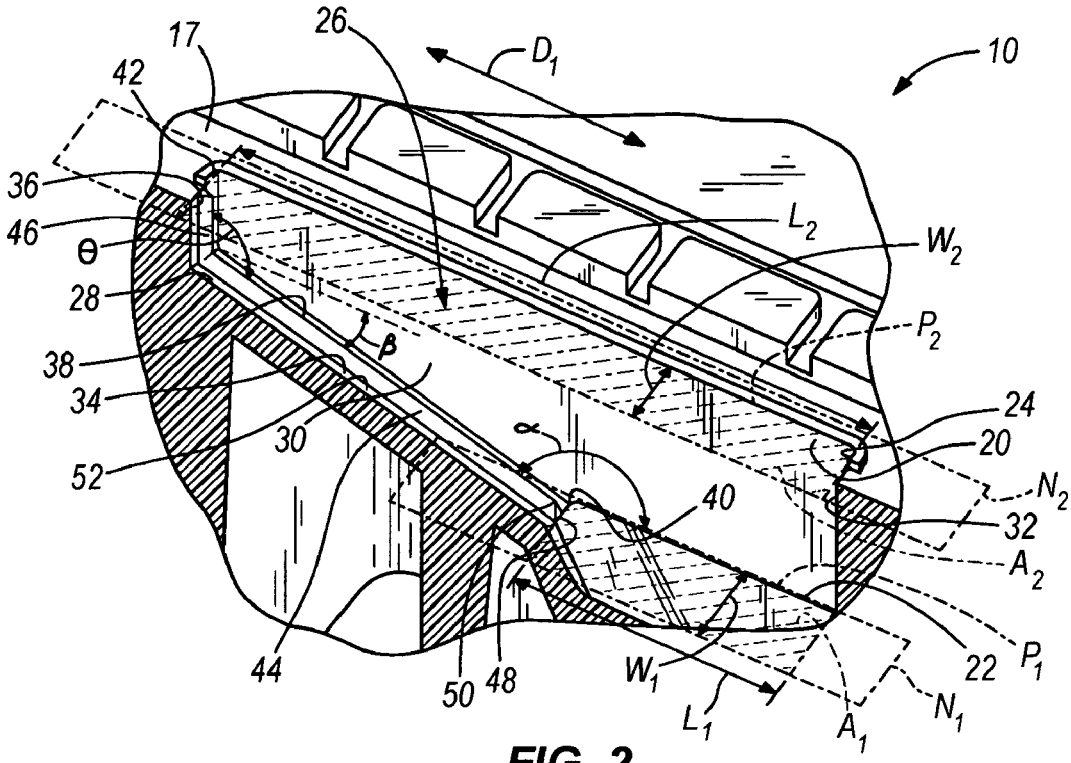
FIG. 2 is a close-up perspective view of the inkjet printhead of FIG. 1.

FIGS. 1 and 2 illustrate an inkjet printhead 10 according to an embodiment of the present invention. As shown in FIG. 1, the printhead 10 includes a housing 12 that defines a nosepiece 11 and one or more ink reservoirs 14. In other embodiments, the housing 12 can have other shapes, some of which have no identifiable nosepiece. The housing 12 can be constructed of a variety of materials, including without limitation polymers, metals, ceramics, composites, and the like.

Each ink reservoir 14 contains ink, which in some cases can at least partially saturate an insert (not shown) received within the reservoir 14. As used herein and in the appended claims, the term "ink" can refer to at least one of inks, dyes, stains, pigments, colorants, tints, a combination thereof, and any other material that can be used by inkjet printers to print matter upon a printing medium. As also used herein and in the appended claims, the term "printing medium" can refer to at least one of paper (including without limitation stock paper, stationary, tissue paper, homemade paper, and the like), film, tape, photo paper, a combination thereof, and any other medium upon which material can be printed by an inkjet printer.

In some embodiments, the printhead 10 has a chip 13 and a nozzle plate 15 for ejecting ink to a printing medium. As used herein, the term "chip" refers to one or more layers of material having one or more arrays of heat transducers that can correspond to fluid channels, firing chambers and nozzles ("flow features") in one or more layers of a nozzle plate 15. The chip 13 can be in fluid communication with the nozzle plate 15, such as one or more ink slots in the chip 13 in fluid communication with the flow features of the nozzle plate 15. In some embodiments, one or more layers of the chip 13 are in fluid communication with one or more ink reservoirs 14 in the housing 12.

The chip 13 and the nozzle plate 15 described above can be coupled to the printhead 10 such that each of the ink reservoirs 14 is in fluid communication with a respective set of heat transducers and flow features in the chip 13 and nozzle plate 15, respectively. In some embodiments, the nozzle plate 15 includes only a portion of the flow features (e.g., the nozzles), and other substrates or layers positioned intermediately of the chip 13 and the nozzle 15 define the remaining flow features (e.g., the fluid channels and firing chambers). It should be understood that the flow features can be located or arranged in any other manner in one or more substrates or other elements.

With reference to the illustrated embodiment of FIGS. 1 and 2, ink is directed along a fluid path from an ink reservoir 14 toward an outer surface 17 of the housing 12, the chip 13, and the nozzle plate 15, such that the ink enters one or more firing chambers (not shown), and is eventually fired from corresponding nozzles (also not shown). As used herein, the term "fluid path" is defined with respect to macroscopic fluid flow through the printhead, rather than a path followed by trace amounts of ink entering and passing through the printhead.

Ink located in a firing chamber can be heated and vaporized by signaling a corresponding heat transducer in the chip 13 to heat up the ink in the firing chamber. The ink can thereby be expelled outwardly from the printhead 10 through a corresponding nozzle toward a printing medium. In some embodiments, the chip 13 is in electrical communication with a printer controller that controls when ink is ejected from various nozzles toward a printing medium.

With reference now to FIG. 1, the inkjet printhead 10 can comprise a filter tower 16 to which a filter (not shown) can be coupled to filter ink as the ink flows from the corresponding ink reservoir 14 toward the outer surface 17. Ink can be directed from the filter tower 16 to one or more ink feeds 18. Ink can further be directed from each ink feed 18 to a corresponding chip feed 20. From each chip feed 20, ink can be directed toward the outer surface 17 (and the chip 13 and nozzle plate 15, when the chip 13 and nozzle plate 15 are coupled to the printhead 10).

The chip feed 20 is shown in greater detail in FIG. 2. The chip feed 20 includes an inlet 22 defined at least partially by a first perimeter $P_1$, and an outlet 24 defined at least partially by a second perimeter $P_2$. The second perimeter $P_2$ in the illustrated embodiment is substantially greater than the first perimeter $P_1$. The inlet 22 is in fluid communication with the ink feed 18, and the outlet 24 is in fluid communication with the outer surface 17 of the housing 12 and/or to the chip 13 and nozzle plate 15, if coupled to the housing 12. The outlet 24 of the embodiment illustrated in FIGS. 1 and 2 is defined in the outer surface 17. In other embodiments, the outlet 24 can be defined by other surfaces of the housing 12.

A first plane $N_1$ is located at the inlet 22, and defines an upstream end of the chip feed 20 and a first cross-sectional area $A_1$ of the chip feed 20 at the inlet 22. In some embodiments (such as that shown in FIGS. 1 and 2), the first plane $N_1$ is defined by a plane passing through the fluid path and separating the upstream ink feed 18 from diverging walls of the downstream chip feed 20. Also, in some embodiments, the first plane $N_1$ is substantially perpendicular to the fluid path and/or the walls through which ink flows from the ink feed 18 to the chip feed 20. In these and other embodiments, the ink feed 18 and the chip feed 20 can be formed by different elements (such as by different die pieces in a molding process). In such cases, the first plane $N_1$ can be defined at and by the interface between the ink feed 18 and chip feed 20 formed by different elements in the printhead manufacturing process, and, in some embodiments, this will also include curved surfaces.

The outlet 24 of the printhead 10 lies in a second plane $N_2$, which defines a downstream end of the chip feed 20 and a second cross-sectional area $A_2$ of the chip feed 20 at the outlet 24. In some embodiments (such as that shown in FIGS. 1 and 2), the second plane $N_2$ is located immediately upstream of the chip 15 and/or nozzle plate 13 (if employed). In these and other embodiments, the second plane $N_2$ can lie in a plane coincident with the outer surface 17 of the printhead 10 adjacent the outlet 24. Also, the second plane $N_2$ can be substantially perpendicular to the fluid path and/or the walls through which ink flows from the chip feed 20 toward the nozzles.

With continued reference to the embodiment illustrated in FIGS. 1 and 2, the second cross-sectional area $A_2$ is substantially greater than the first cross-sectional area $A_1$. That is, the second cross-sectional area $A_2$ is greater than the first cross-sectional area $A_1$ by more than what would result from, or be required for, standard fabrication techniques used to create an chip feed having a substantially constant cross-sectional area along its length (e.g., resulting from the draft necessary to produce such an chip feed).

In some embodiments, the first cross-sectional area $A_1$ is defined at least in part by a first width $W_1$ and first length $L_1$ the same as or greater than the first width $W_1$, and the second cross-sectional area $A_2$ is defined at least in part by a second width $W_2$ and second length $L_2$ greater than the second width $W_2$. In some embodiments, the second length $L_2$ can be substantially greater than the first length $L_1$.

The chip feed 20 illustrated in FIGS. 1 and 2 is elongated in a first direction $D_1$, and defines a chamber 26 having a number of walls (only first, second, third walls 28, 30, 32 are shown in FIGS. 1 and 2 for clarity), or transition surfaces, positioned between the inlet 22 and the outlet 24. The inlet 22 and the outlet 24 are also generally elongated in the direction $D_1$. The first wall or transition surface 28 includes two substantially straight portions: a first portion 34 and a second portion 36. The first and second portions 34 and 36 lie in respective planes at an angle $\theta$ with respect to one another. The angle $\theta$ is substantially greater than zero degrees. In the embodiment illustrated in FIGS. 1 and 2, the angle θ is substantially greater than ninety degrees. The first portion 34 extends generally in the direction $D_1$ and, in some cases, defines a roof of the chamber 26. In some embodiments, the first wall 28 has a surface 52 that at least partially faces the outlet 24 of the chip feed 20.

In some embodiments, the first portion 34 of the first wall 28 extends at least partially from the inlet 22 to the outlet 24 (e.g., at least partially between a point on the first perimeter $P_1$ and a point on the second perimeter $P_2$). For example, the first portion 34 of the first wall 28 illustrated in FIG. 2 extends the majority of the distance from the inlet 22 to the outlet 24. The first portion 34 can be inclined to at least partially connect an end 40 of the first length $L_1$ to an end 42 of the second length $L_2$. In other words, the first portion 34 can be inclined relative to the first and second planes $N_1$ and $N_2$, thereby forming an angle α with respect to the first plane $N_1$ that is substantially greater than zero degrees. In some embodiments (such as the embodiment illustrated in FIGS. 1 and 2), the angle α is substantially greater than ninety degrees. The first portion 34 can also form an angle β with respect to the second plane $N_2$ that is substantially greater than zero degrees and substantially less than ninety degrees. In other embodiments, such as where the ink feed 18 is centrally located with respect to the outlet 24, the angle β can be substantially less than 90 degrees. For example, in some embodiments, the angle β can be about zero degrees, and in other embodiments, the angle β can be about twelve degrees.

In the illustrated embodiment of FIGS. 1 and 2, a projection 38 extends along the first and second portions 34 and 36 of the first wall 28. Thus, the projection 38 has a first portion 44 and a second portion 46 oriented at an angle θ with respect to one another, wherein the angle θ is substantially greater than zero degrees (and in some embodiments is substantially greater than 90 degrees as shown in FIGS. 1 and 2). The projection 38 keeps bubbles in the chamber 26 away from the first wall 28 to allow ink to flow around such bubbles. Alternatively or in addition, the projection 38 can enable bubbles in the chamber 26 to move along the first wall 28 (e.g., toward the inlet 22 and out of the chamber 26) rather than becoming stuck against the first wall 28. Therefore, the projection 38 can prevent depriming or ink starvation of the chip 13 and/or nozzle plate 15.

The projection 38 of the embodiment illustrated in FIGS. 1 and 2 includes a base 48 and a tip 50 disposed a distance from the base 48 away from the first wall 28. The illustrated projection 38 tapers from the base 48 to the tip 50. The projection 38 can therefore have a triangular cross-sectional shape. One of ordinary skill in the art will recognize that molding constraints or other considerations can lead to embodiments in which the tip 50 is rounded. Other projection shapes are possible, and fall within the spirit and scope of the present invention. For example, the projection 38 can instead have a rounded cross-sectional shape, can have a rectangular or other polygonal cross-sectional shape, and the like. The projection 38 can thereby provide a surface (whether along a line or along a plane) that is narrower than the width of the chamber 26 at the location of the projection 38, thereby keeping bubbles a distance from the base of the projection 38 and the rest of the first wall 28.

The projection 38 need not necessarily be a continuous feature extending along the first wall 28. Instead, the projection 38 can be broken into two or more sections and/or can extend along less than the entire length of the first wall 38 while still performing the functions described above. That is, the projection 38 may include a series of protrusions, a series of recesses, or combinations thereof, such as alternating protrusions and recesses, as long as the projection 38 (or projection-like structure 38) performs the bubble handling functions described above. For example, in some embodiments, the first portion 34 may lie in a plane coincident with the first plane $N_1$ (i.e., the angle α is 180 degrees) with a gradually increasing slope (such as the slope shown in FIGS. 1 and 2) from the inlet 22 to the outlet 24 created from a protrusion that gradually increases in height, or from a series of increasingly larger protrusions or recesses.

Figure 2A:
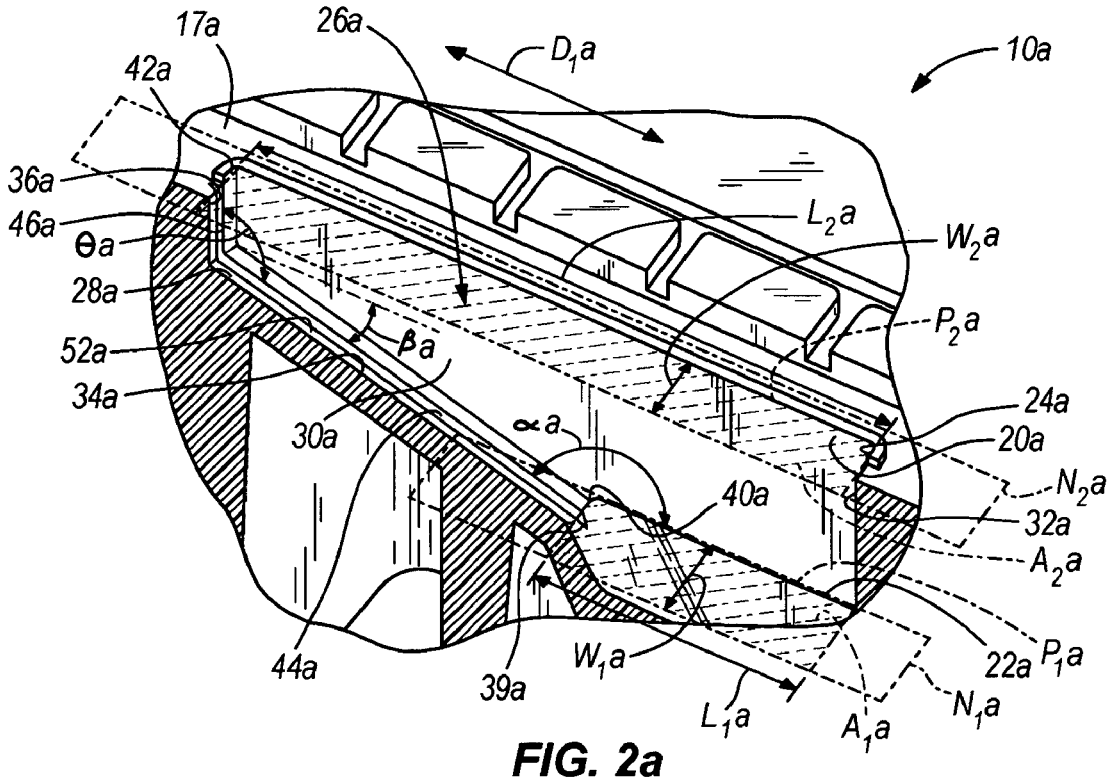
FIG. 2*a* is a close-up perspective view of an inkjet printhead according to a second embodiment of the present invention.

In some embodiments, the first wall 28 also or instead has a recess extending along the first wall 28 in a manner similar to the projection 38 described above. For example, the printhead 10*a* illustrated in FIG. 2*a* is the same as that illustrated in FIGS. 1 and 2, with the exception of a recess 39*a* rather than a projection extending along the first and second portions 34*a* and 36*a* of the first wall 28*a*. Accordingly, the features and elements in FIG. 2 are given the same numbers in FIG. 2*a*, followed by the letter "a". The recess 39*a* can be defined in a surface 52*a* of the first wall 28*a*. Also, the recess 39*a* can perform the same functions as the projection 38 described above, thereby promoting ink flow past bubbles in the chamber 26*a* and/or bubble movement along the first wall 28*a*. With reference to FIGS. 1–2*a*, it should also be noted that the surface 52, 52*a* of the first wall 28, 28*a* can include one or more projections 38, one or more recesses 39*a*, and combination thereof.

Figure 3:
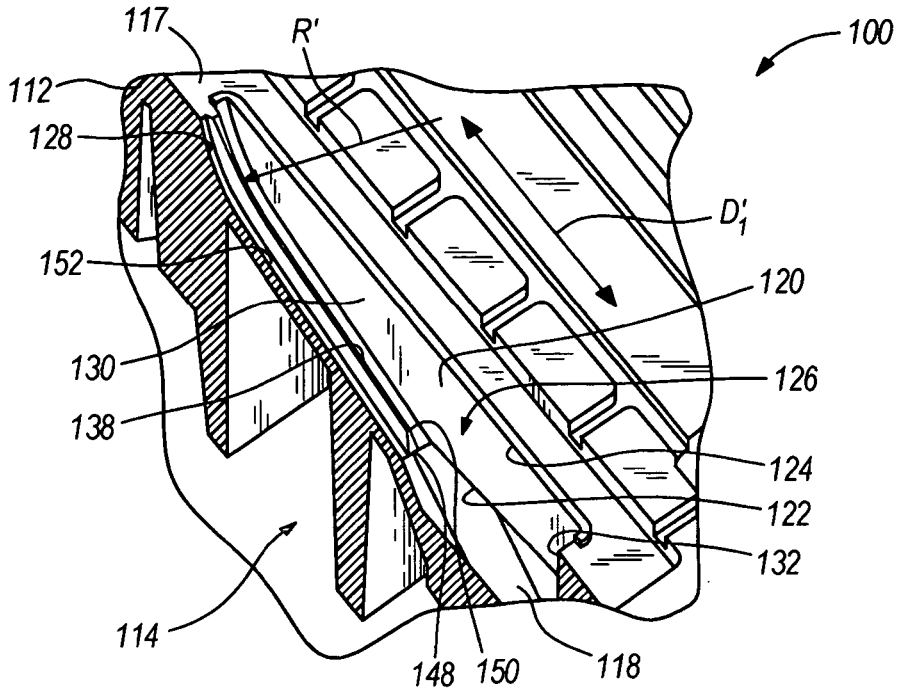
FIG. 3 is a close-up perspective view of an inkjet printhead according to a third embodiment of the present invention.

FIG. 3 illustrates an inkjet printhead 100 according to another embodiment of the present invention, wherein like numerals represent like elements. With the exception of the features described below, the printhead 100 illustrated in FIG. 3 is the same as that illustrated in FIGS. 1 and 2. Therefore, reference is made to the description above accompanying FIGS. 1 and 2 for a more complete description of the features and elements (and alternatives to such features and elements) of the printhead 100 illustrated in FIG. 3. Also, elements and features corresponding to elements and features in the illustrated embodiment of FIGS. 1 and 2 are provided with the same reference numerals in the 100 series, or with a prime (') after the numeral. For clarity, planes, cross-sectional areas, lengths, widths, perimeters and angles have been removed from FIG. 3. However, the relationships described above with regard to the first and second planes $N_1$ and $N_2$, the first and second cross-sectional areas $A_1$ and $A_2$, the first and second lengths $L_1$ and $L_2$, and the first and second perimeters for $P_1$ and $P_2$ of the inkjet printhead 10 illustrated in FIGS. 1 and 2 are equally applicable to the printhead 110 illustrated in FIG. 3.

The printhead 110 illustrated in FIG. 3 has an chip feed 120 including an inlet 122 and an outlet 124. The inlet 122 is in fluid communication with the ink feed 118, and the outlet 124 is in fluid communication with the outer surface 117 of the housing 112 and/or to the chip and nozzle plate (not shown), if coupled to the housing 112.

The chip feed 120 illustrated in FIG. 3 is elongated in a first direction $D_1$', and defines a chamber 126 having a first wall 128, a second wall 130 and a third wall 132 (other walls not shown for clarity). The inlet 122 and the outlet 124 are also generally elongated in the direction $D_1$'. The first wall 128 extends generally in the direction $D_1$', and in some cases can define a roof of the chamber 126. In some embodiments, the first wall 128 has a surface 152 that at least partially faces the outlet 124 of the chip feed 120.

The first wall 128 is curved such that the surface 152 is concave as viewed from the outlet 124. In other words, the first wall 128 is curved to present a concave surface 152 to the outlet 124. The first wall 128 can have a constant or non-constant radius of curvature R.

With continued reference to FIG. 3, the first wall 128 extends from the inlet 122 to the outlet 124, and in other embodiments extends partially from the inlet 122 to the outlet 124. Also, only a portion of the first wall 128 illustrated in FIG. 3 is curved (i.e., that portion adjacent the outlet 124). In other embodiments, one or more other portions of the first wall 128 can be curved as described above, such as a concave middle portion of the first wall 128 and/or a concave portion of the first wall 128 adjacent the inlet 122. Any portion(s) or all of the entire first wall 128 can be curved with any constant or non-constant radius of curvature R.

A projection 138 extends along the first wall 128. Similar to the projection 38 of the inkjet printhead 10 illustrated in FIGS. 1 and 2, the projection 138 includes a base 148 and a tip 150 disposed a distance from the base 148. The projection 138 tapers from the base 148 to the tip 150. As described above, other projection shapes are possible, and fall within the spirit and scope of the present invention. As also described above, in some embodiments the first wall 128 has a recess in addition to or instead of the projection 138. The surface 152 of the first wall 128 can have any number of projections 138, recesses, and combinations thereof extending along any portion or all of the first wall 128 to perform the same bubble handling functions described above. By virtue of the curved shape of the first wall 128 described above, the projection(s) 138 and/or recesses can also be curved to present a concave profile toward the outlet 124.

Figure 4:
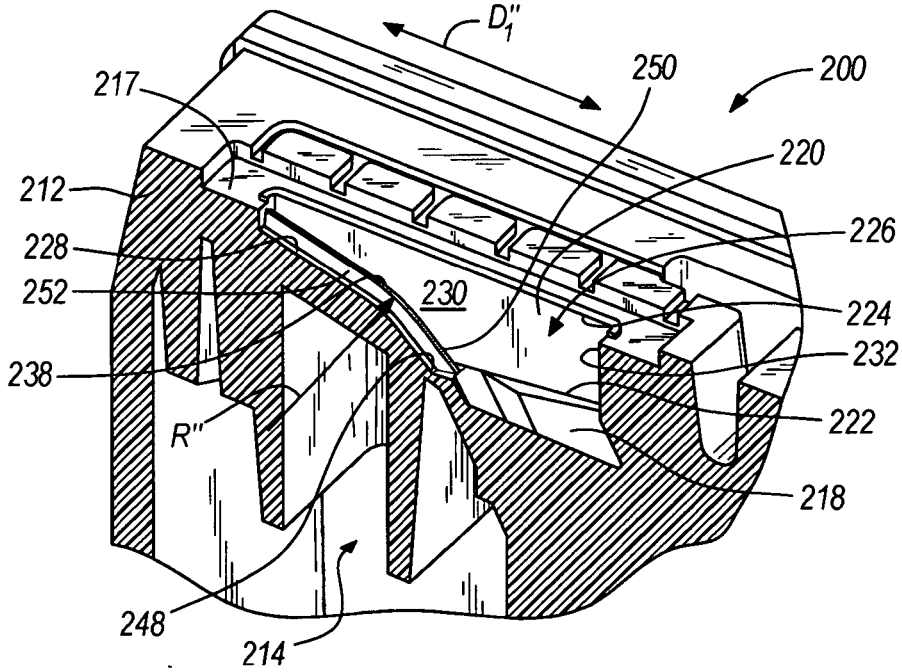
FIG. 4 is a close-up perspective view of an inkjet printhead according to a fourth embodiment of the present invention.

FIG. 4 illustrates an inkjet printhead 200 according to another embodiment of the present invention, wherein like numerals represent like elements. With the exception of the features described below, the printhead 200 illustrated in FIG. 4 is the same as that illustrated in FIGS. 1 and 2. Therefore, reference is made to the description above accompanying FIGS. 1 and 2 for a more complete description of the features and elements (and alternatives to such features and elements) of the printhead 200 illustrated in FIG. 4. Also, elements and features corresponding to elements and features in the illustrated embodiment of FIGS. 1 and 2 are provided with the same reference numerals in the 200 series, or with a double prime (") after the numeral. For clarity, planes, cross-sectional areas, lengths, widths, perimeters and angles have been removed from FIG. 4. However, the relationships described above with regard to the first and second planes $N_1$ and $N_2$, the first and second cross-sectional areas $A_1$ and $A_2$, the first and second lengths $L_1$ and $L_2$, and the first and second perimeters for $P_1$ and $P_2$ of the inkjet printhead 10 illustrated in FIGS. 1 and 2 are equally applicable to the printhead 210 illustrated in FIG. 4.

The printhead 210 illustrated in FIG. 4 has an chip feed 220 including an inlet 222 and an outlet 224. The inlet 222 is in fluid communication with the ink feed 218, and the outlet 224 is in fluid communication with the outer surface 217 of the housing 212 and/or to the chip and nozzle plate (not shown), if coupled to the housing 212.

The chip feed 220 illustrated in FIG. 4 is elongated in a first direction $D_1$", and defines a chamber 226 having a first wall 228, a second wall 230 and a third wall 232 (other walls not shown for clarity). The inlet 222 and the outlet 224 are also generally elongated in the direction $D_1$". The first wall 228 extends generally in the direction $D_1$", and in some cases can define a roof of the chamber 226. In some embodiments, the first wall 228 has a surface 252 that at least partially faces the outlet 224 of the chip feed 220.

The first wall 228 is curved such that the surface 252 is convex as viewed from the outlet 224. In other words, the first wall 228 is curved to present a convex surface 252 to the outlet 224. The first wall 228 can have a constant or non-constant radius of curvature R".

With continued reference to FIG. 4, the first wall 228 extends from the inlet 222 to the outlet 224, and in other embodiments extends partially from the inlet 222 to the outlet 224. Also, only a portion of the first wall 228 illustrated in FIG. 4 is curved (i.e., a middle portion of the first wall 228). In other embodiments, one or more other portions of the first wall 228 can be curved as described above, such as a convex portion adjacent the inlet 222 and/or a convex portion adjacent the outlet 224. Any portion(s) or all of the entire first wall 228 can be curved with any constant or non-constant radius of curvature R".

A projection 238 extends along the first wall 228. Similar to the projection 38 of the inkjet printhead 10 illustrated in FIGS. 1 and 2, the projection 238 includes a base 248 and a tip 250 disposed a distance from the base 248. The projection 238 tapers from the base 248 to the tip 250. As described above, other projection shapes are possible, and fall within the spirit and scope of the present invention. As also described above, in some embodiments the first wall 228 has a recess in addition to or instead of the projection 238. The surface 252 of the first wall 228 can have any number of projections 238, recesses, and combinations thereof extending along any portion or all of the first wall 228 to perform the same bubble handling functions described above. By virtue of the curved shape of the first wall 228 described above, the projection(s) 238 and/or recesses can also be curved to present a convex profile toward the outlet 224.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the first walls 128, 228 (and projections 138, 238) illustrated in the embodiments of FIGS. 3 and 4 can be replaced by first walls 128, 228 (and projections 138, 238) having a plurality of straight portions each oriented at an angle with respect to one another to perform a function similar to the curved first walls 128, 228 and projections 138, 238.

The foregoing description and related figures describe the various angles between the planes and printhead members using ranges of degrees or using static values as examples. However, one of ordinary skill in the art will readily recognize that these angles can be variable and/or may have dynamic values in some embodiments.

What is claimed is:

1. An inkjet printhead comprising:

a housing having an ink reservoir;

an outer surface of the housing;

an ink feed at least partially defining a fluid path extending from the ink reservoir toward the outer surface;

a chip feed having an inlet in fluid communication with the ink feed and an outlet in fluid communication with the outer surface;

a first plane at the inlet defining a first cross sectional area of the chip feed at the inlet, the first plane separating the ink feed from the chip feed;

a second plane in which the outlet lies, the second plane defining a second cross sectional area of the chip feed at the outlet, the second cross sectional area being substantially greater than the first cross-sectional area; and at least one of a projection and a recess positioned along a transition surface of the chip feed between the inlet and the outlet.

2. The inkjet printhead as claimed in claim 1, wherein the outlet of the chip feed is defined in the outer surface of the housing.

3. The inkjet printhead as claimed in claim 1, wherein: the chip feed defines a chamber having a roof, and the transition surface at least partially defines the roof.

4. The inkjet printhead as claimed in claim 1, wherein at least a portion of the transition surface is curved to present a substantially convex surface to the outlet.

5. The inkjet printhead as claimed in claim 1, wherein at least a portion of the transition surface is curved to present a substantially concave surface, a substantially convex surface, or a combination of convex and concave surfaces with respect to the outlet.

6. The inkjet printhead as claimed in claim 1, wherein the transition surface is inclined relative to the second plane, and forms an angle with the second plane substantially greater than zero degrees and substantially less than 90 degrees.

7. The inkjet printhead as claimed in claim 1, wherein: the first cross-sectional area is at least partially defined by a first width and a first length greater than the first width, the second cross-sectional area is at least partially defined by a second width and a second length greater than the second width, and the second length is substantially greater than the first length.

8. The inkjet printhead as claimed in claim 7, wherein the transition surface is inclined to at least partially connect an end of the first length with an end of the second length.

9. The inkjet printhead as claimed in claim 1, wherein the transition surface includes a substantially straight first portion and a substantially straight second portion, the first and second substantially straight portions lying in respective planes at an angle with respect to one another, and wherein the angle is substantially greater than zero degrees.

10. An inkjet printhead comprising:

a housing having an ink reservoir;

an outer surface of the housing;

an ink feed at least partially defining a fluid path extending from the ink reservoir toward the outer surface;

an chip feed positioned to fluidly couple the ink feed and the outer surface, the chip feed defining a chamber having a roof elongated in a first direction and an outlet elongated substantially in the first direction; and at least one of a projection and a recess extending along at least part of the roof in the first direction wherein the at least one of a projection and a recess includes a first substantially straight portion extending along the roof and a second substantially straight portion oriented at an angle with respect to the first substantially straight portion, and wherein the angle is substantially greater than zero degrees.

11. The inkjet printhead as claimed in claim 10, wherein the outlet of the chip feed is defined in the outer surface of the housing.

12. The inkjet printhead as claimed in claim 10, wherein the roof is curved to present at least one of a concave surface and a convex surface to the outlet.

13. The inkjet printhead as claimed in claim 10, further comprising: a first plane at the inlet, the first plane defining a first cross sectional area of the chip feed at the inlet; and a second plane in which the outlet lies, the second plane defining a second cross sectional area of the chip feed at the outlet, the second cross sectional area being substantially greater than the first cross-sectional area.

14. The inkjet printhead as claimed in claim 13, wherein the inlet is elongated in the first direction.

15. The inkjet printhead as claimed in claim 13, wherein the inlet is defined by a first perimeter, the outlet is defined by a second perimeter, and the roof extends at least partially between a point on the first perimeter and a point on the second perimeter.

16. The inkjet printhead as claimed in claim 10, wherein: the at least one of a projection and a recess includes a base and a tip disposed a distance from the base, and the at least one of a projection and a recess tapers from the base to the tip.

17. An inkjet printhead comprising:

a housing having an ink reservoir;

an outer surface of the housing;

an ink feed at least partially defining a fluid path extending from the ink reservoir toward the outer surface;

an chip feed having an inlet in fluid communication with the ink feed and an outlet in fluid communication with the outer surface;

a first plane at the inlet, the first plane defining a first cross sectional area of the chip feed at the inlet, the first cross-sectional area defined at least in part by a first width and a first length greater than the first width;

a second plane in which the outlet lies, the second plane defining a second cross-sectional area of the chip feed at the outlet, the second cross-sectional area defined at least in part by a second width and a second length greater than the second width, the second length being substantially greater than the first length; and at least one of a projection and a recess extending along a transition surface of the chip feed between the inlet and the outlet.

18. The inkjet printhead as claimed in claim 17, wherein the outlet of the chip feed is defined in the outer surface of the housing.

19. The inkjet printhead as claimed in claim 17, wherein the transition surface is positioned to at least partially connect an end of the first length to an end of the second length.

20. The inkjet printhead as claimed in claim 17, wherein the transition surface is inclined relative to the second plane, and forms an angle with the second plane substantially greater than zero degrees and substantially less than 90 degrees.

21. The inkjet printhead as claimed in claim 17, wherein the transition surface is curved to present at least one of a concave surface and a convex surface to the outlet.

22. The inkjet printhead as claimed in claim 17, wherein the first cross-sectional area is substantially less than the second cross-sectional area.

* * * * *